United States Patent [19]

Schindelhauer

[11] 4,105,375

[45] Aug. 8, 1978

[54] ROTARY PISTON COMPRESSOR

[75] Inventor: Gerhard Schindelhauer, Berlin, Fed. Rep. of Germany

[73] Assignees: Borsig GmbH, Berlin; Wankel GmbH, Lindau, both of Fed. Rep. of Germany

[21] Appl. No.: 541,438

[22] Filed: Jan. 16, 1975

[30] Foreign Application Priority Data

Jan. 17, 1974 [DE] Fed. Rep. of Germany ..... 2402084

[51] Int. Cl.[2] ..... F04C 29/08

[52] U.S. Cl. ..... 418/54

[58] Field of Search ..... 418/54, 58, 61 R

[56] References Cited

U.S. PATENT DOCUMENTS

| | | | |
|---|---|---|---|
| 553,086 | 1/1896 | Wheildon | 418/54 |
| 1,310,157 | 7/1919 | De Campo | 418/54 |
| 1,340,625 | 5/1920 | Planche | 418/54 |
| 4,061,445 | 12/1977 | Doshi | 418/54 |

FOREIGN PATENT DOCUMENTS

| | | | |
|---|---|---|---|
| 907,575 | 3/1946 | France | 418/54 |
| 14,547 of | 1885 | United Kingdom | 418/54 |

*Primary Examiner*—Carlton R. Croyle
*Assistant Examiner*—Leonard E. Smith
*Attorney, Agent, or Firm*—Walter Becker

[57] ABSTRACT

A rotary piston compressor with inlet and outlet passages the confinements of which for the inlet and outlet of the medium to be conveyed to the working chambers have controlling functions in cooperation with sealing elements. When the piston is within the region from the dead point of the piston to a point as far as to a location of the piston being turned further by a few degrees measured relative to turning of the eccentric shaft the leading seal element in the direction of piston rotation is located immediately preceeding the start of the inlet passage which communicates with a space of relatively low pressure.

4 Claims, 2 Drawing Figures

ROTARY PISTON COMPRESSOR

The present invention relates to a rotary piston compressor with inlet and outlet passages the confinement of which for the inlet and outlet of the medium to and from the working chambers have control functions in cooperation with sealing elements.

With rotary piston compressors of this type, the piston by means of its sealing system separates the working chambers communicating with the inlet passage from the working chambers with the medium to be compressed while both working chambers continuously vary their volume. Each working chamber therefore requires an opening for the intake operation and an opening for the exhaust operation of the conveying medium. These openings, generally known as inlet and outlet passage, thus have controlling functions which means that they determine the timewise course of the intake, compression and reexpansion. This timewise course is of importance for the prime mover driving the rotary piston compressor and the parts interconnecting the same. This importance consists in that the driving torque line will be influenced thereby. A straight line course as possible of this line is desired, in other words, a constant torque.

With heretofore known rotary piston compressors, it is customary to start the access to the working chamber with expanding medium toward the inlet passage so far behind the dead center point of the piston until the compressed gas from the dead chamber has conveyed its energy to the piston. During this gas expansion with the release of energy to the piston, a change in the prefix in the course of the torque occurs because the effective line of the resultant gas force moves beyond the center line of the drive shaft. Due to this brief torque reversal, shortly prior to the opening of the said working chamber toward the inlet passage, the rotary piston compressor which now works as prime mover drives briefly its driving engine, which fact brings about rotary oscillations in the drive shaft.

The effect of the starting torque reversal is delayed only until the torque resulting from the frictional forces in the rotary piston compressor has been overcome. The rotary oscillations are reduced by the provision of flywheel discs or fly masses. However, they cannot prevent the damaging effect of the torque reversal onto the drive shaft with coupling and driving engine and thus onto the entire rotary piston compressor unit. When employing such unit in cases where particular safety requirements have to be met, extreme damage may be the result of the above mentioned arrangement. Moreover, the said fly mass considerably increases the weight of the rotary piston compressor.

It is, therefore, an object of the present invention to provide a rotary piston compressor of the above mentioned general type in which, however, the harmful torque reversal will be eliminated.

This object and other objects and advantages of the invention will appear more clearly from the following specification in connection with the accompanying drawings, in which.

The rotary piston compressor with inlet and outlet passages, the confinements of which for the intake and outlet of the medium to the working chambers have control functions in cooperation with sealing elements, is characterized primarily in that within the region of the dead center point of the piston until as far as to a location of the piston being turned further by a few degrees measured relative to turning of an eccentric shaft a positive sealing element for sealing the working chamber having a medium compressed therein is located at the start of a passage which latter communicates with a chamber of a relatively low pressure.

For using the inlet and outlet passages as passages leading to a chamber of a relatively low pressure, it is suggested according to a further development of the invention that the said passage start is identical either with the start of the inlet passage or the start of the outlet passage, or of the inlet passage and simultaneously of the outlet passage.

Figure 1:
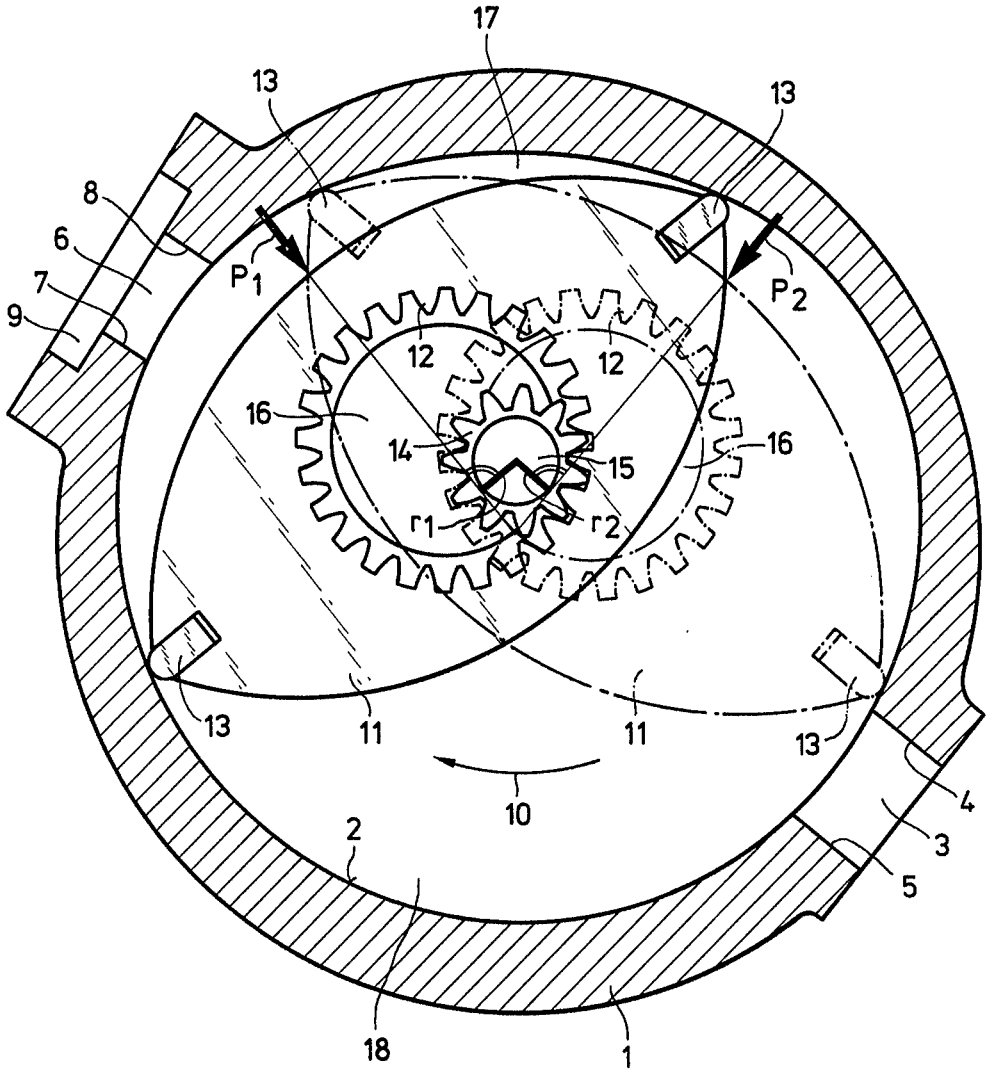
FIG. 1 represents a cross section through a circular piston compressor of a heretofore known type which shows two corner pistons in a position prior to the dead center point and in another position behind the dead center point with a sealing strip shortly ahead of the start of the inlet passage.

Referring now to the drawings in detail, FIG. 1 shows a circular piston compressor of a known general design. In a mantle 1 with a trochoidal mantle path 2, the inlet passage 3 with the passage start 4 and the passage end 5 and the outlet passage 6 with the passage start 7, passage end 8 and recess 9 for a pressure valve, the piston 11 with inner teeth 12 and sealing strips 13 rotates in the direction of rotation 10 about a stationary pinion 14. This rotation is effected by means of a driven eccentric shaft 15 with eccentric 16. The piston 11 divides the inner chamber of mantle 1 into working chambers 17 and 18. In FIG. 1 at two positions of piston 11 there is clearly shown how the above described torque reversal will occur with heretofore known rotary piston compressors. In the position of piston 11 ahead of the dead center point, a torque is obtained from the resultant gas force $P_1$ of the gas of the working chamber 17 with compressed medium and the lever arm $r_1$ of $P_1 \times r_1$ which lever arm is perpendicular to said torque which acts in counter clockwise direction, and in another position of the piston 11 behind the dead center point, the torque $P_2 \times r_2$ acts in clockwise direction.

Figure 2:
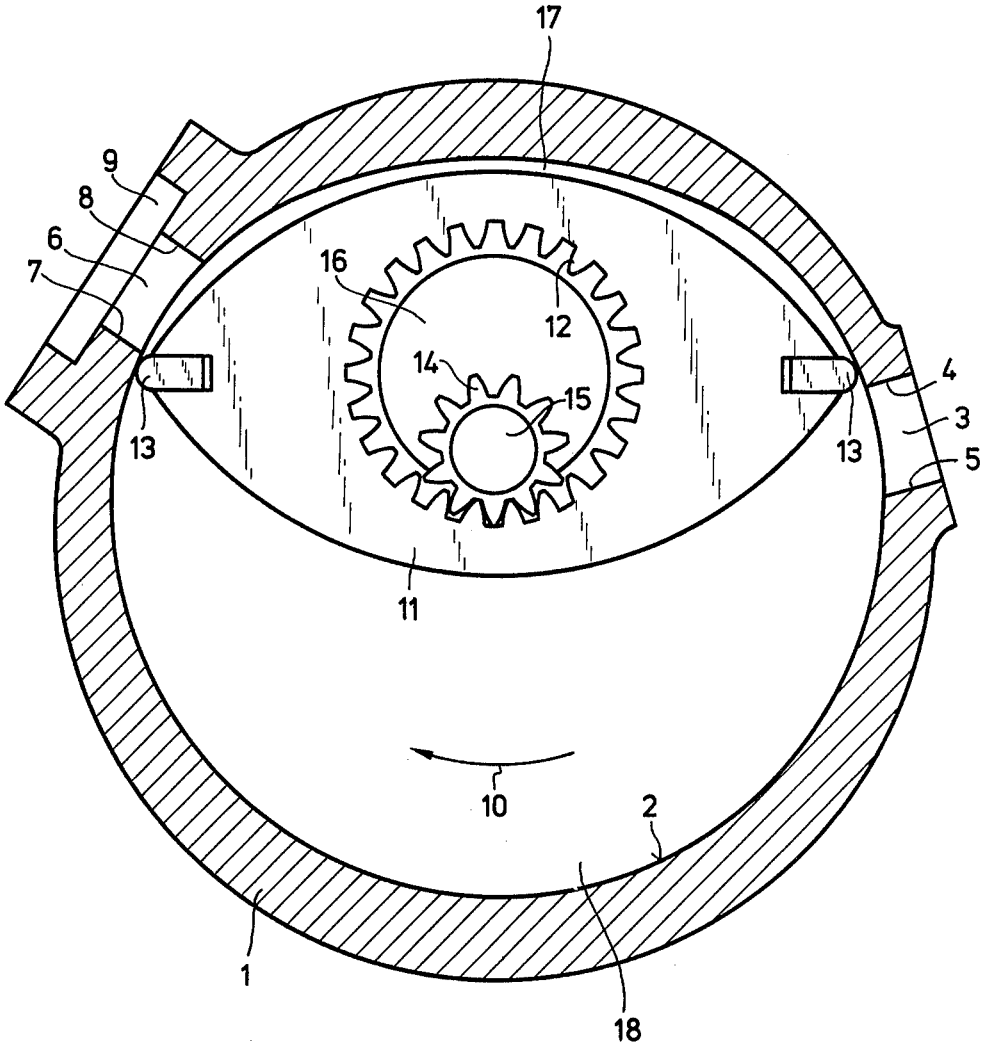
FIG. 2 represents a cross section through a circular piston compressor which shows a two-corner piston in its dead center position while both sealing strips are located shortly ahead of the start of the inlet and outlet passage.

This torque reversal is eliminated according to the present invention as shown in FIG. 2. If on the short stroke of the sealing strip 13 along the mantle path 2 from the position of piston 11 in the dead center point to the start of the passage 4 or 7, a torque can build up in view of the gas force $P_2$, which torque is directed in clockwise direction, this torque cannot act upon the eccentric shaft 15. This is due to the fact that the oppositely acting torque of all frictional forces within the rotary piston compressor is greater. Also, torque reversal is prevented by locating the inlet port to vent the pressure from the compressed chamber. The inlet is placed in a position where the torque exerted by the gas pressure is less than the frictional forces.

As will be evident from the above, the advantages obtained by the present invention consist primarily in that due to the elimination of the torque reversal, the damaging or harmful effects upon the clutch and the driving engine will be eliminated and the rotary piston compressor unit will be considerably lighter and smaller in view of the elimination of special fly masses so that the rotary piston compressor according to the invention will have a wider field of use.

It is, of course, to be understood that the present invention is, by no means, limited to the specific showing in the drawings but also comprises any modifications within the scope of the appended claims.

What I claim is:

1. In combination with a fast running rotary piston compressor with a housing which consists of a stationary mantle defining a running path with a surface having multiple bore trochoid form and side portions therewith including an eccentric shaft passing at right angles therethrough and having an eccentric portion with a multiple corner piston rotatably journalled thereby including a piston flank forming a compression chamber so that the piston moves with corners thereof along the inside of the mantle and so that piston movement is controlled by a drive consisting of a hollow wheel fixed on the piston and a pinion fixed on one of the side portions whereby opening and closing of inlet and outlet openings of the housing become controlled by the contours of the piston, the improvement therewith comprises when the piston has a location in the dead point position to a position resulting due to further turning of the eccentric shaft up to a few degrees, the start of an inlet passage inside the mantle being arranged directly ahead of the location where a leading corner of the piston in the direction of piston rotation engages the mantle.

2. A rotary piston compressor in combination according to claim 1, in which a start of an outlet passage is arranged directly ahead of the location where a trailing corner of the piston in the direction of piston rotation engages against the mantle when the piston has a location in dead point position to a position resulting due to further turning of the eccentric shaft up to a few degrees with respect to the flank of the piston forming the compression chamber inside the mantle.

3. In a fast running rotary piston compressor having a housing and a rotary piston defining a working chamber between the housing and piston, sealing elements on said rotary piston for sealing the working chamber having medium compressed therein, an eccentric shaft upon which the piston is mounted for rotation, said piston having a dead center point whereby the volume of the working chamber is at a minimum, the housing being provided with inlet and outlet passages cooperating with the sealing elements for controlling the passage of working medium in and out of the chamber, the improvement comprising that when the piston is within the region from the dead center point of the piston to a point as far as to a location of the piston being turned further by a few degrees measured relative to turning of the eccentric shaft the leading seal element of the piston in the direction of piston rotation is located immediately preceeding the start of the inlet passage which communicates with a space of relatively low pressure.

4. A rotary piston compressor in combination according to claim 3, in which the start of the passage is identical with the start of the outlet passage.

* * * * *